US005683089A

United States Patent [19]

Clark

[11] Patent Number: 5,683,089

[45] Date of Patent: Nov. 4, 1997

[54] NUMERICALLY-SCORED CHESS-LIKE BOARD GAME

[76] Inventor: William H. Clark, 5180 Kingsford Dr., Trotwood, Ohio 45426

[21] Appl. No.: 686,868

[22] Filed: Jul. 26, 1996

[51] Int. Cl.[6] ..... A63F 3/02

[52] U.S. Cl. ..... 273/260; 273/248

[58] Field of Search ..... 273/242, 243, 273/248, 249, 260, 261

[56] References Cited

U.S. PATENT DOCUMENTS

| | | | |
|---|---|---|---|
| 104,370 | 6/1870 | Vander Weyde . | |
| 665,123 | 1/1901 | McLoughlin . | |
| 998,233 | 7/1911 | Crocker . | |
| 1,085,941 | 2/1914 | Russell . | |
| 3,130,972 | 4/1964 | Schwarzlander . | |
| 3,633,913 | 1/1972 | Solimene | 273/248 |
| 3,730,527 | 5/1973 | Nelson . | |
| 3,791,648 | 2/1974 | Patterson | 273/248 |
| 3,863,927 | 2/1975 | Moritz . | |
| 4,093,237 | 6/1978 | Weiss | 273/260 |
| 4,119,321 | 10/1978 | Creel | 273/248 |
| 4,256,309 | 3/1981 | McQuillan | 273/258 |
| 4,613,134 | 9/1986 | Tobin | 273/242 |
| 5,116,062 | 5/1992 | Johnson | 273/260 |
| 5,228,699 | 7/1993 | Ludwick et al. | 273/260 |
| 5,306,016 | 4/1994 | McInnis | 273/258 |
| 5,333,877 | 8/1994 | Pridgeon et al. | 273/248 |
| 5,427,379 | 6/1995 | Lee | 273/281 |

FOREIGN PATENT DOCUMENTS

| | | | |
|---|---|---|---|
| 2703919 | 10/1994 | France | 273/260 |

*Primary Examiner*—William E. Stoll

[57] ABSTRACT

A board game for two players includes a board with a rectangular grid of discrete playing positions denoted thereon to form a central playing zone, and a line of discrete scoring positions denoted thereon to form a scoring zone on each end and each side of the playing zone. Each scoring position is marked with a number denoting its value. A set of game pieces is provided for each player, and the pieces are marked with numbers to denote values corresponding to scoring position values. The opposing end scoring zones comprise starting zones, and the pieces are initially placed on like-valued positions within each starting zone. The allowed movement of a piece on each turn is dictated by its value, with the object being to place each piece in a like-valued scoring position in a side zone or in the scoring zone opposite the starting zone. A game ends when one player has all his pieces so positioned, and a point score is awarded each player in relation to the value of each piece in a scoring position. All game pieces remain on the board throughout the game, and are defensively deployed to block opponent's moves as they are maneuvered into scoring positions.

13 Claims, 3 Drawing Sheets

Figure 5:
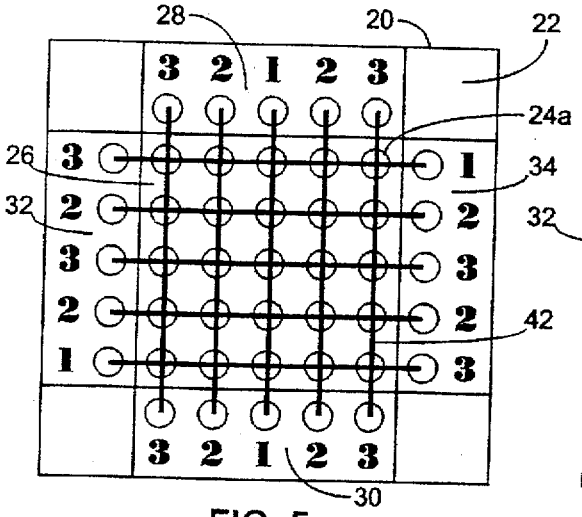
Figure 6:
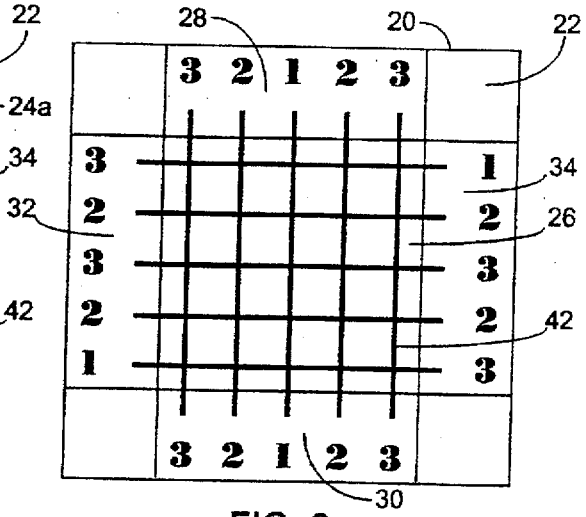
Figure 7:
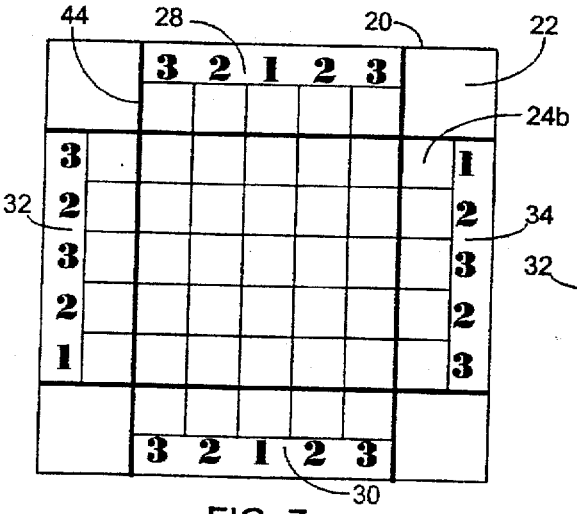

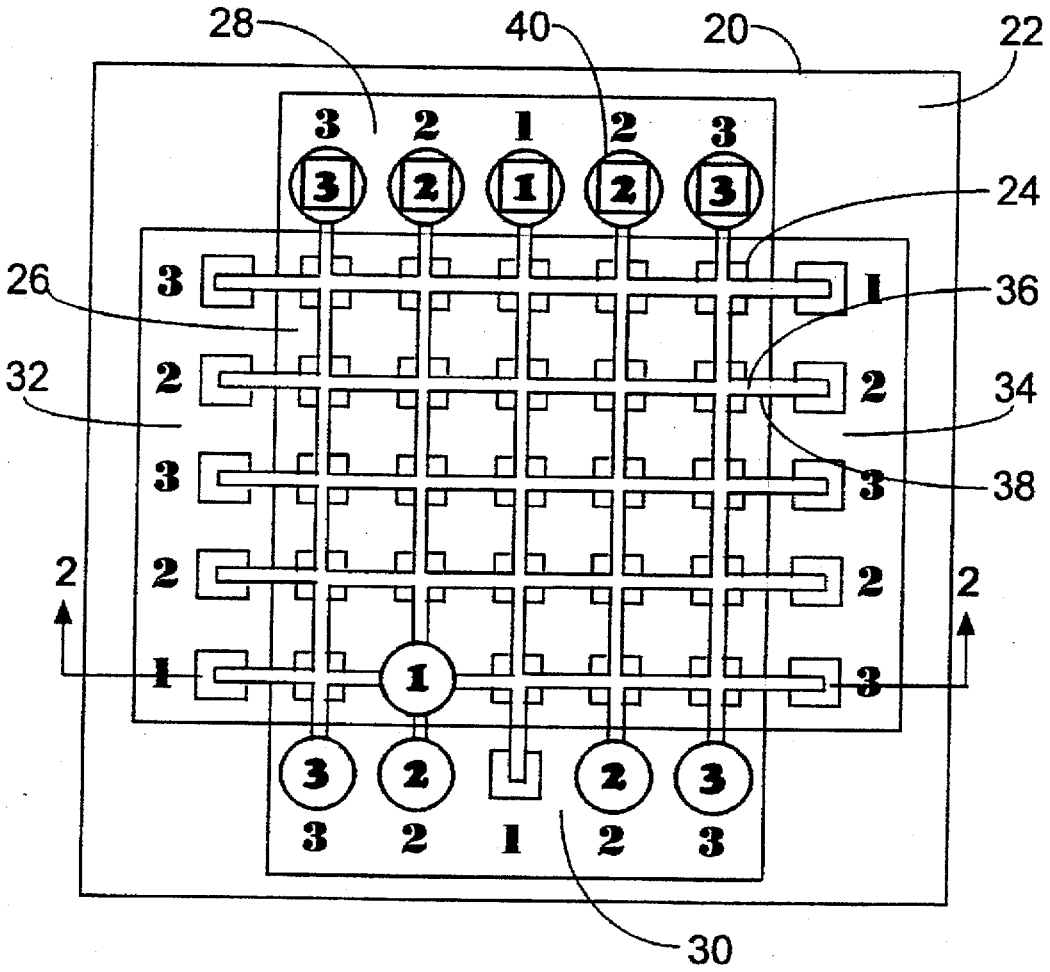
FIG. 1
FIG. 2
PRIOR ART
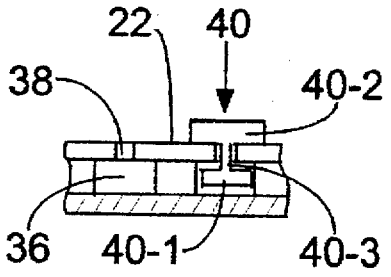
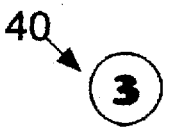
FIG. 3
FIG. 4
PRIOR ART
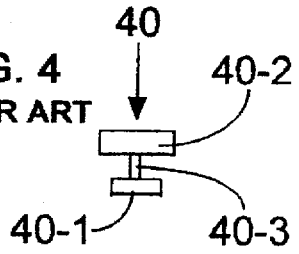

NUMERICALLY-SCORED CHESS-LIKE BOARD GAME

BACKGROUND

1. Field of Invention

This invention relates to games, and more particularly to games having a board over which game pieces are moved by two opposing players.

2. Discussion of Prior Art

The game of chess is recognized as one of the most enduring games ever devised for the test of skill of two players, but its complexity has limited the extent of its appeal. Over the years, many other games have been devised, wherein some of the elements of chess are present, which were intended to be easier to play, to appeal to a larger number of players, and, in some cases, to provide for an outcome which includes a definitive measure of the relative skill of the players. The majority such games include a board having a grid of playing positions and distinguishable sets of playing pieces, wherein individual playing positions, individual playing pieces, or both, have identifying characteristics or value attributes which individually or conjunctively dictate allowable movement of the pieces and determination of the outcome according to the rules of the game, exemplified, for example, by those such as shown in U.S. Pat. No. 104,370 to Vander Weyde (1870), U.S. Pat. No. 665,123 to McLoughlin (1901), U.S. Pat. No. 998,233 to Crocker (1911), U.S. Pat. No. 3,730,527 to Nelson (1973), U.S. Pat. No. 3,863,927 to Moritz (1975), U.S. Pat. No. 4,256,309 to McQuillan (1981), U.S. Pat. No. 4,613,134 to Tobin (1986), and U.S. Pat. No. 5,306,016 to McInnis (1994). Also pursuant to the broadening of their appeal, game devices for use in the play of such games have been developed wherein the movable pieces are captured on the gameboard against loss during storage, and are restricted from inadvertent movement when the game is played during travel, exemplified, for example by those such as shown in U.S. Pat. No. 1,085,941 to Russell (1914), U.S. Pat. No. 3,130,972 to Schwarzlander (1964), and U.S. Pat. No. 5,427,379 to Lee (1995).

The games shown in U.S. Pat. No. 998,233 to Crocker, U.S. Pat. No. 3,863,927 to Moritz, and U.S. Pat. No. 4,613,134 to Tobin all include the awarding of point scores to determine the winner, thereby providing a measurement of relative skill, but all include removal of pieces from the playing surface during play, thereby complicating implementation of the game on a gameboard of the type suitable for play during travel.

OBJECTS AND ADVANTAGES

Upon inspection of the drawings, the present invention may appear similar to other games of the prior art. However, the present invention has structure, rules of play, and amusement and teaching characteristics that distinguish it from those games which may be similar, but individually different. Accordingly, several objects and advantages of the present invention are:

(a) to provide a new and novel board game which has a limited set of rules, is easy to learn, and is interesting to play, (b) to provide a board game which is educational and develops arithmetic skills, (c) to provide a board game which can be enjoyed by children, yet offers a significant challenge to highly skilled players, (d) to provide a board game wherein the outcome is entirely dependent upon the skill of the players and point scores are awarded to determine the winner, and (e) to provide a board game which can be readily implemented on a board of the type wherein movable pieces are captured against loss and restriction of the movement of the pieces makes the game suitable for play during travel.

Still further objects and advantages will become apparent from a consideration of the ensuing description and drawings.

DRAWING FIGURES

Figure 8:
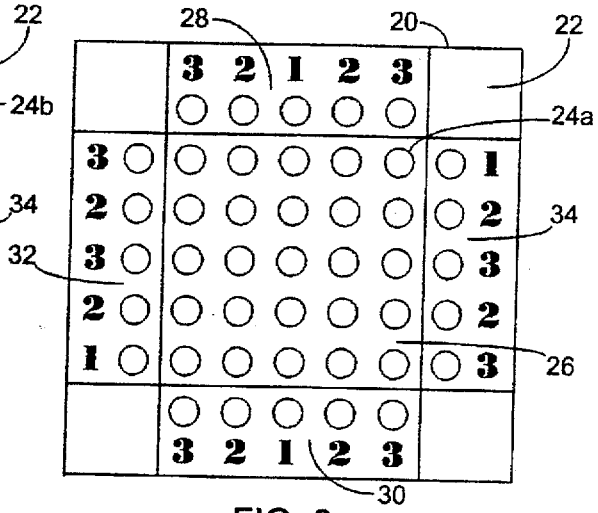
Figure 9:
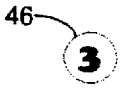
Figure 10:
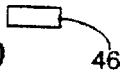
Figure 11:
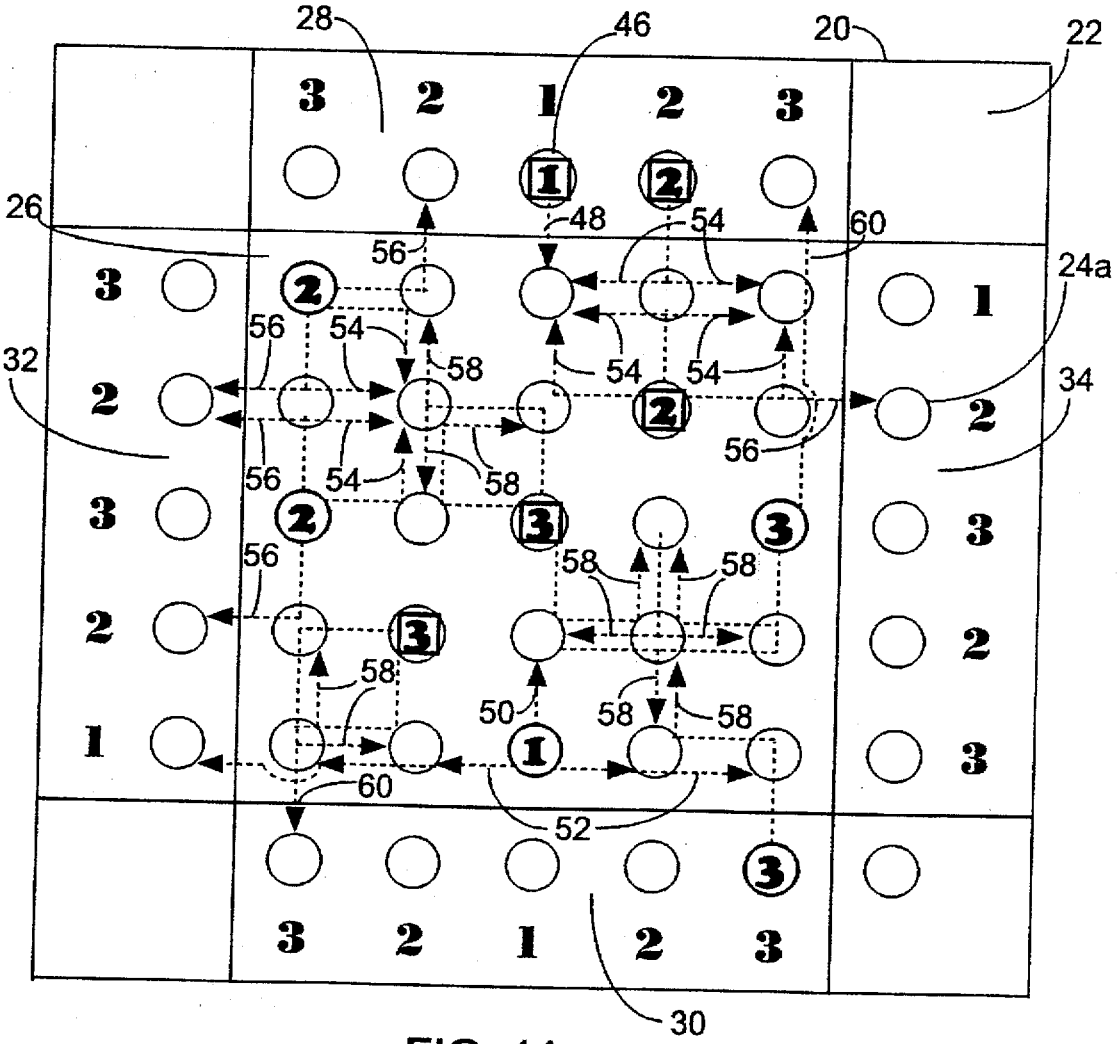

FIG. 1 is a plan view of a gameboard, with game pieces thereon, constructed in accordance with the present invention, FIG. 2 is a partial sectional view along the line 2—2 of FIG. 1, FIG. 3 is a plan view of a game piece suitable for use with the gameboard of FIG. 1, FIG. 4 is a side view of the game piece of FIG. 3, FIGS. 5 to 8 are plan views of other embodiments of a gameboard constructed in accordance with the present invention, FIG. 9 is a plan view of a game piece suitable for use with the gameboards of FIGS. 5 to 8, FIG. 10 is a side view of the game piece of FIG. 9, and FIG. 11 is a plan view of the gameboard of FIG. 8, with game pieces thereon, including arrows illustrating legal moves of the game pieces.

REFERENCE NUMERALS IN DRAWINGS

| | |
|---|---|
| 20 | gameboard |
| 22 | gameboard surface |
| 24 | square denoting playing and scoring positions |
| 26 | playing zone |
| 28 | first end scoring zone |
| 30 | second end scoring zone |
| 32 | first side scoring zone |
| 34 | second side scoring zone |
| 36 | recessed channel |
| 38 | channel slot |
| 40 | game piece - preferred embodiment |
| 42 | track line |
| 44 | line defining scoring zones |
| 46 | game pieces - other embodiments |
| 48 to 60 | arrows showing legal moves |

SUMMARY OF THE INVENTION

The present invention includes a gameboard having a flat surface with a rectangular grid of playing positions imprinted thereon to form a central playing zone. A row of scoring positions, equal in number to the number of columns in the playing zone, is imprinted on the surface to form a scoring zone at each end of the playing zone. A column of scoring positions, equal in number to the number of rows in the playing zone, is imprinted on the surface to form a scoring zone at each side of the playing zone. The end scoring zones also comprise starting zones for the two players. A number is imprinted near each scoring position to denote its value, with the sequence of values denoted in each end scoring zone being the same. A set of similar but distinguishable game pieces is provided for each of the players, and each of the game pieces is marked with a number corresponding to one of the numbers in a scoring zone. The piece numbers dictate the number of positions and number of directions each piece must be moved during a single turn. The object of the game is for each player to move his game pieces, by exact count, to like-numbered positions within the scoring zones in a manner which will attain the highest total point score at the end of the game, with points being awarded in relation to the value of the pieces in scoring positions. All game pieces remain on the playing surface throughout the game, and are defensively deployed by each player as they are maneuvered into scoring positions.

Description—FIGS. 1 to 4

The preferred embodiment includes a gameboard 20 having a flat surface 22. A plurality of squares 24 are imprinted on surface 22 to form a rectangular grid of playing positions in playing zone 26. A row of squares 24, equal in number to the number of columns in playing zone 26 is imprinted at each end of surface 20 to form scoring positions in end scoring zones 28 and 30. End scoring zone 28 comprises the starting zone for one player and a scoring zone for a second player. Similarly, end scoring zone 30 comprises the starting zone for the second player and a scoring zone for the first player. A column of squares 24, equal in number to the number of rows in playing zone 26, is imprinted on each side of playing zone 26 to form scoring zones 32 and 34. Each square within each of the four scoring zones is numbered to denote its value, as seen by the numbers "1", "2", and "3" in FIG. 1. The set of numbers within zone 28 is the same as the set of number in zone 30, and their sequences are preferably the same when viewed from each end of the gameboard. Similarly, the sets of numbers within side zones 32 and 34 are the same, and their sequences are preferably the same.

A plurality of recessed channels 36, best seen in FIG. 2, are provided to form a grid of tracks interconnecting squares 24. Each channel communicates with surface 22 through a narrowed slot 38.

Two sets of game pieces 40 are provided, each set being distinguishable from the other by size, shape, color, texture, or the like. Each piece is imprinted with a number denoting its value, such that the piece values of each set correspond to the position values within each starting zone, and the pieces are initially placed on like-numbered positions within the starting zones. The sequence of position values within the end scoring zones is preferably selected during construction to maximize the number of moves required to move game pieces from a starting zone to its opposing end scoring zone, in accordance with the rules of play described below, and the sequence of position values in the side zones is selected during construction to require a lesser number of moves from a starting zone to each side scoring zone.

Each game piece 40 includes a base 40-1 which is captured within channel 36, and a head 40-2 which projects above surface 22. The base and head are interconnected by a neck 40-3 which passes through slot 38 to allow free movement of the piece along and between channels.

Description—FIGS. 5 to 10

Examples of other embodiments of the gameboard are seen in FIGS. 5 to 8, each of which includes surface 22, playing zone 26, scoring zones 28, 30, 32 and 34, and numbers denoting scoring position values, as previously described and seen in FIG. 1. In a second embodiment, seen in FIG. 5, the playing positions and scoring positions are denoted by circles **24*a*, and a plurality of lines 42 are delineated on surface 22 to interconnect the circles and form a grid of tracks for movement of the game pieces between the circles. In a third embodiment, seen in FIG. 6, a grid of playing positions is defined by the intersections of lines 42, and scoring positions are defined by the ends of lines 42. In a fourth embodiment, seen in FIG. 7, the playing positions and scoring positions are defined by contiguous squares 24*b*, and the scoring zones are defined by heavy lines 44. In a fifth embodiment, seen in FIG. 8, playing and scoring positions are defined by circles 24*a*. Two sets of game pieces, seen in FIGS. 9 and 10, are provided which are suitable for use with the gameboard embodiments seen in FIGS. 5 to 8**. As previously described, each piece is imprinted with a number denoting its value, such that the piece values of each set correspond to the position values within each starting zone.

Description—FIG. 11

The general rules of play will now be explained with reference to FIG. 11. For illustrative convenience, it is assumed that the Player A uses pieces marked with white numbers, his starting zone is end zone 28, and his scoring zones are end zone 30 and side zones 32 and 34; Player B uses pieces marked with black numbers, his starting zone is zone 30, and his scoring zones are end zone 28 and side zones 32 and 34. Also for illustrative convenience, the gameboard of FIG. 8 is utilized for FIG. 11.

The value of a particular piece 46 specifies the paths over which it may move, as described below. The piece may not move diagonally, and may not move onto or through a circle which is occupied by another piece. Furthermore, a piece may not return to its starting zone, nor may a piece be moved after it has been placed in a scoring zone.

The players alternate turns, and the objective of each player is to move each of his pieces, by exact count as described below, to a circle of like value in one of his scoring zones, such that he has accumulated a higher point score than his opponent when the game ends. The game ends when one player has moved all his pieces to scoring positions. Each player's point score is then determined by summing the values of his pieces which are on scoring circles, with the points awarded for each piece in an end scoring zone being twice the indicated value. If the other player has any pieces remaining in his starting zone, twice the value of each piece in the starting zone is subtracted from his point total.

An number "1" piece may first be moved one circle out of its starting zone, as illustrated by arrow 48. On subsequent moves, the number "1" piece may be moved any number of circles in one direction, as illustrated by arrow 50 and by multi-headed arrows 52.

On any turn except when moving to a scoring circle, a number "2" piece must be moved first one circle along a row or column and then one circle in a perpendicular direction, for a total of two circles, as illustrated by arrows 54. A number "2" piece may be moved by exact count, to a like-numbered circle in a scoring zone over one or two directions, as illustrated by arrows 56. A number "2" piece will therefore always end a turn two circles away from the starting circle for the turn.

On any turn except when moving to a scoring circle, a number "3" piece must be moved three circles along rows or columns over three directions, as illustrated by arrows 58. A number "3" piece may be moved, by exact count, to a like-numbered circle in a scoring zone over one, two or three directions, as illustrated by arrows 60. A number "3" piece will therefor always end a turn either one or three circles away from the starting circle for the turn.

When either player has moved his number "1" piece to a scoring circle within one of his scoring zones, the other player must, on all subsequent moves, make a legal scoring move with one of his pieces if such a move is possible.

If a player makes an illegal move of an odd-numbered piece, the opponent may, at his option, require that the move be corrected. However, if not corrected prior to the opponent's next move, the illegal move stands. If a player makes an illegal move of an even-numbered piece, the illegal move may be corrected at any time thereafter, with the opponent having the option of requiring that the correction be made by moving the piece one circle less or one circle more than a legal move. If at any time a player cannot make a legal move, he forfeits his turn until such time as he can make a legal move. In the event of a stalemate, caused by repetition of a set of moves, either player may declare the stalemate, thereby requiring the other player to choose between breaking the stalemate and declaring the game ended. When a game is so ended, each player's point score is computed in the manner described above.

Conclusion Ramification and Scope

According, the reader will see that the number of permutations of moves and counter-moves available to the players is very large, and that movement of the pieces to achieve the highest point total involves strategic positioning which includes defensive deployment. However, it is possible for children or unskilled players to employ strategies involving only a few future moves, while highly skilled players may employ more far-reaching strategies. Furthermore, the game has additional advantages in that a) it provides a game having a limited set of rules, wherein the outcome is entirely dependent upon the skill of the players, and point scores are awarded such that a measurement of relative skill is indicated, b) it provides a game wherein the permutations of available moves are of sufficient number to prevent the play from developing without variety, c) it provides a game which is easy to learn, wherein some of the qualities of chess are present, d) it provides a game wherein arithmetic skills are challenged and enhanced, e) it provides a game wherein stalemates are resolved, and the possibility of a draw is minimized, and f) it provides a game wherein all the players pieces remain on the playing surface throughout the game, with none of the pieces being captured or displaced, thereby facilitating implementation of the game on a gameboard of the type wherein game pieces are captured against loss and their movement is restricted in a manner which makes the game suitable for play during travel, Although the description above contains many specificity's, they should not be construed as limiting the scope of the invention but merely providing illustrations of some of the preferred embodiments of the invention. For example, value attributes other than those shown may be denoted during construction, playing and scoring positions may be denoted by any suitable symbols or shapes, various weighting factors may be applied to scoring position values in the awarding of point scores, etc.

Thus the scope of the invention should be determined by the appended claims and their legal equivalents, rather than by the examples given.

I claim:

1. A board game for two players comprising a gameboard with a flat surface having a rectangular grid of discrete playing positions denoted thereon to form a central playing zone, a row of scoring positions, equal in number to the number of columns in said grid, being denoted on said surface to form an end zone on each end of said playing zone, each of said end zones comprising a starting zone for one of the players and a scoring zone for the other player, a column of scoring positions, equal in number to the number of rows in said grid, being denoted on said surface to form a side scoring zone for both players on each side of said playing zone, each of said scoring positions being further denoted by a position number, the sets of position numbers comprising each of said end zones being the same, each of the position numbers in said side zones corresponding to 8 position number in said end zones, a first and second set of game pieces being provided, each set of said game pieces being distinguishable from the other by size, shape, color, or texture, the value of each of said game pieces being denoted by a piece number, the piece numbers comprising the first set of game pieces being the same as the piece numbers comprising the second set of game pieces, each of said piece numbers corresponding to the number denoting a different position number within one of said end zones, each set of said pieces being initially placed in a starting zone, the movement of each individual piece being in relation to the number denoted thereon, the object being to place each of said game pieces on a like-numbered position within one of said scoring zones, the game ending when one of the players has all of his game pieces so positioned.

2. A board game according to claim 1, further including a plurality of lines delineated on said surface to provide a grid of tracks for the movement of said pieces along rows and columns between said playing positions, and between said playing positions and said scoring positions.

3. A board game according to claim 1, further including a grid of recessed channels beneath said surface for the capture of said game pieces within the channels and the movement of said game pieces along rows and columns between said playing positions, and between said playing positions and said scoring positions, each of said channels communicating with said surface through a narrowed slot, each of said game pieces including a base captured within said channel and a head projecting above said surface, said base and head being interconnected by a neck passing through said slot.

4. A board game according to claim 1, wherein a plurality of lines are delineated on said surface to further define said end and side zones.

5. A board game according to claim 1, wherein the sequence of position numbers denoted in each of said end scoring zones is the same.

6. A board game according to claim 1, wherein the sequence of position numbers denoted in each of said side scoring zones is the same.

7. A board game according to claim 1, wherein the initial placement of the sets of game pieces includes the additional requirement that the game pieces be placed on like-numbered positions.

8. A board game according to claim 1, wherein a game piece may not move back into its starting zone and may not be moved out of a scoring zone.

9. A board game according to claim 1, wherein each player is awarded a point score at the end of the game, each player's point score being in relation to the value of each of his pieces which are located within a scoring zone at the end of the game.

10. A board game according to claim 9, wherein the method of awarding points includes weighting the value of each game piece in a plurality of said scoring positions.

11. A board game according to claim 9, wherein the method of awarding points includes subtracting from a player's point score the value of each of his pieces which remains in its starting zone at the end of the game.

12. A board game according to claim 1, further including a rule for resolving a stalemate during the course of play, wherein either player is allowed to declare the stalemate and thereby require the other player to choose between breaking the stalemate and declaring the game ended.

13. A board game according to claim 1, further including a rule for correction of a player's illegal move, wherein the opponent is afforded the option of dictating the nature of the move to be used for said correction.

* * * * *

UNITED STATES PATENT AND TRADEMARK OFFICE

CERTIFICATE OF CORRECTION

PATENT NO. : 5,683,089

DATED : Nov. 4, 1997

INVENTOR(S) : William H. Clark

It is certified that error appears in the above-identified patent and that said Letters Patent is hereby corrected as shown below:

Col. 6, line 10: change "8" to – a –.

Signed and Sealed this

Twenty-fourth Day of February, 1998

*Attest:*

Bruce Lehman

BRUCE LEHMAN

*Attesting Officer*

*Commissioner of Patents and Trademarks*